United States Patent [19]

Bleeke

[11] Patent Number: 4,540,964

[45] Date of Patent: Sep. 10, 1985

[54] MAGNETIC SWITCH APPARATUS

[75] Inventor: William F. Bleeke, Fort Wayne, Ind.

[73] Assignee: Xolox Corporation, Fort Wayne, Ind.

[21] Appl. No.: 615,048

[22] Filed: May 29, 1984

[51] Int. Cl.[3] ..... H01H 36/00

[52] U.S. Cl. ..... 335/205; 335/202; 338/32 H

[58] Field of Search ..... 335/205, 202; 338/32 H; 361/400, 405, 417, 419

[56] References Cited

U.S. PATENT DOCUMENTS

| | | | |
|---|---|---|---|
| 3,389,317 | 6/1968 | Prewitt | 335/205 |
| 4,334,204 | 6/1982 | Buchanan | 338/32 H |
| 4,346,360 | 8/1982 | Tufo | 335/205 |

*Primary Examiner*—Harold Broome

*Attorney, Agent, or Firm*—George A. Gust

[57] ABSTRACT

Magnetic switch apparatus which includes a casing having a magnetically sensitive component securely positioned therein in a predetermined location. The component may be in the form of either a conventional reed switch or Hall effect sensor and is provided with electrical terminal leads extending therefrom. The casing includes means for locating and securing the leads against movement upon application of a tensile force thereto, such means being in the form of suitable embossments in the casing about which the leads are partially wrapped. The casing further is provided with means for mounting the same on a supporting member, such as a circuit board, in a predetermined position such that the magnetic component will also be correspondingly positioned relative to the supporting member.

12 Claims, 9 Drawing Figures

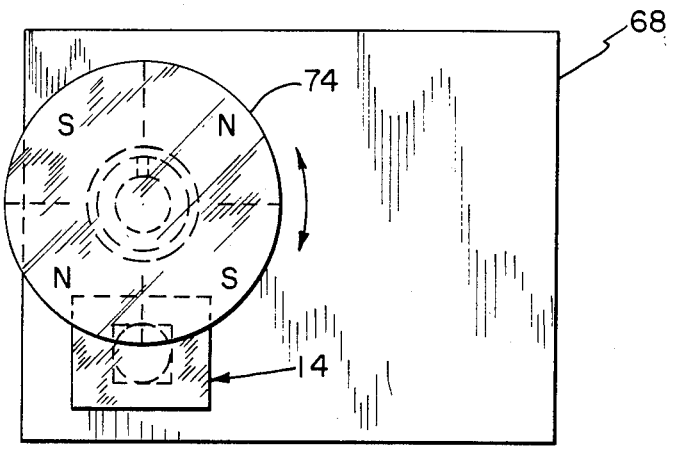
FIG. 1
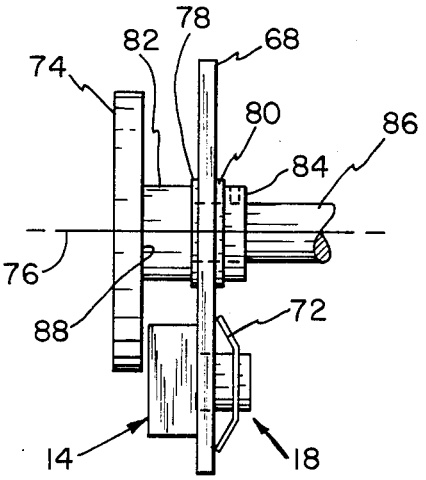
FIG. 2
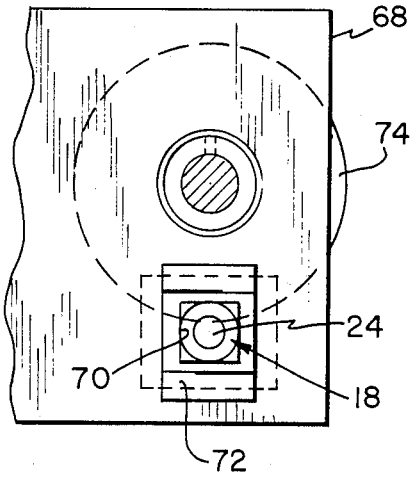
FIG. 3
FIG. 4
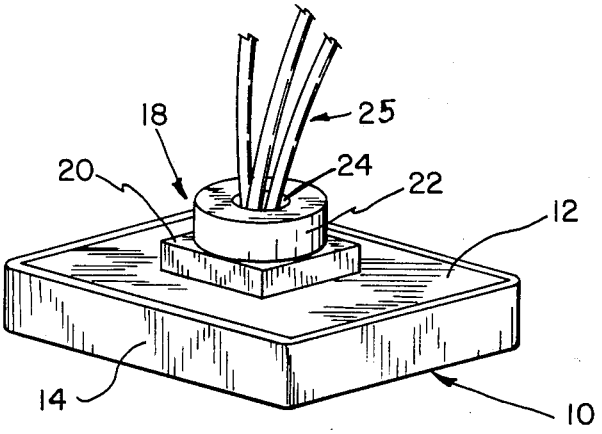

MAGNETIC SWITCH APPARATUS

SUMMARY OF THE INVENTION

The present invention relates to a magnetic switch apparatus and more particularly to an apparatus which may employ either a Hall effect sensor or a reed switch in a predetermined location relative to a rotating magnet.

The magnetic switch apparatus includes a casing of non-magnetic material having a magnetically sensitive component, such as a reed switch or Hall effect sensor, securely positioned therein in a predetermined location. The magnetic component has electrical terminal leads extending therefrom. The casing includes second means for locating and securing the leads against movement upon application of a tensile force thereto.

The casing further includes means for mounting the same on a supporting member, such as a printed circuit board, in a predetermined position relative to a rotating magnet such that the component will be correspondingly positioned relative to such rotating magnet.

More specifically, the magnetic component (reed switch or Hall effect sensor) is located by means of embossments on a supporting plate of non-magnetic material which receives and holds the component against movement in at least one direction. The second means includes lead-locating embossments on the supporting plate about which the leads, respectively, are partially wrapped. The plate further is provided with a lead-receiving aperture through which the leads extend after being wrapped as aforesaid about the lead-locating embossments. The casing preferably includes a cover of non-magnetic material having sides which snugly, securely fit over the perimetral edge of the plate. One of the sides is spaced from the component-locating embossments in juxtaposition therewith and engageably secures such component therebetween.

In order to prevent the apparatus from rotating relative to a printed circuit board into which it is mounted, a projection on the supporting plate is provided, which projection has a square cross-section (or equivalent) adjacent to the plate which is adapted to fit a correspondingly shaped hole in the circuit board. The remainder of the projection is cylindrical with the aforesaid aperture extending therethrough. A suitable friction-type, push-on nut fitted over the cylindrical projection and engaging the circuit board serves in securing the supporting plate and the remainder of the apparatus in fixed relation to the circuit board.

A disc-shaped permanent magnet is mounted near the circuit board on a shaft suitable for rotation about its axis, such magnet overlying the aforesaid apparatus and more particularly the magnetic switching component in spaced relation therewith. The face of the disc-shaped magnet adjacent to the magnetic-switching component is magnetized with circumferentially alternating north and south poles. The fields of these poles are adapted to cut through the magnet-switching component as the disc-magnet is rotated.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings wherein:

FIG. 1 is a top plan view of one embodiment of this invention;

FIG. 2 is an edge view thereof;

FIG. 3 is a bottom view;

FIG. 4 is a perspective view of the magnetic-switching device shown in the preceding figure;

DESCRIPTION OF A PREFERRED EMBODIMENT

Figure 5:
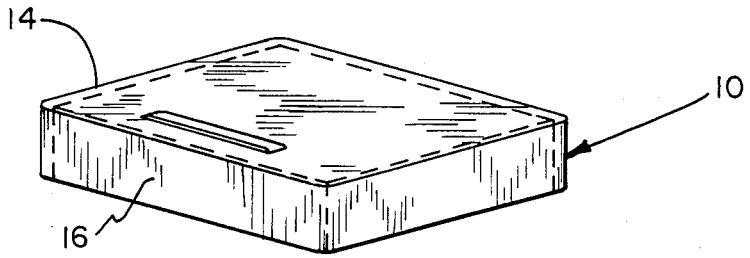
FIG. 5 is a perspective view of the the cover portion of the casing which encloses the electrical parts of the switching device.

Referring to the drawings, the magnetic switching device employed in the apparatus of this invention includes a casing of non-magnetic material, such as molded plastic, nylon being an example, this casing essentially comprising a rectangular shaped a flat supporting plate 12. The cover 10 has a flat top 14 and four flat sides 16. The supporting plate 12 is preferably flat, rectangular shaped and adapted to fit snugly into the cover 10 and to be secured thereto by means of a suitable adhesive or the like. Extending from the central portion of the supporting plate 12, as shown more clearly in FIG. 4, is a projection generally indicated by the numeral 18 which is square in cross-section at the portion 20 immediately adjacent to the supporting plate 12 and therebeyond as indicated by the numeral 22 is cylindrical. The projection 18 has a central aperture 24 which is adapted to receive therethrough electrical leads 25 to be described in more detail hereafter.

On the upper surface of the plate 12 (referring to FIG. 6) are located, as integral parts thereof, a number of post-like embossments in which four of them are arranged at the corners of an imaginary square, these being identified in two pairs or sets, the first set by the numerals 26 and 28 and the second set by the numerals 30 and 32. On a line between the two embossments 30 and 32, but offset from a mid-point therebetween, is an additional embossment 36. Angularly inwardly from the embossment 30 is another embossment 38 and a like embossment 40 is angularly set inwardly from the embossment 32. The purposes of these embossments will be explained later.

Figure 6:
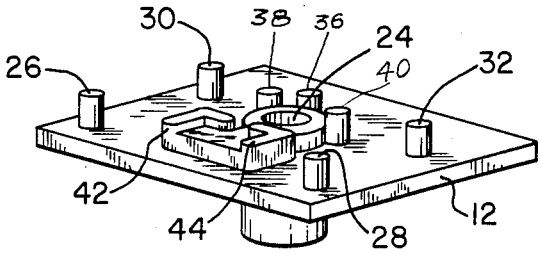
FIG. 6 is a perspective view of the supporting-plate portion of the casing over which the cover of FIG. 5 fits.
Figure 7:
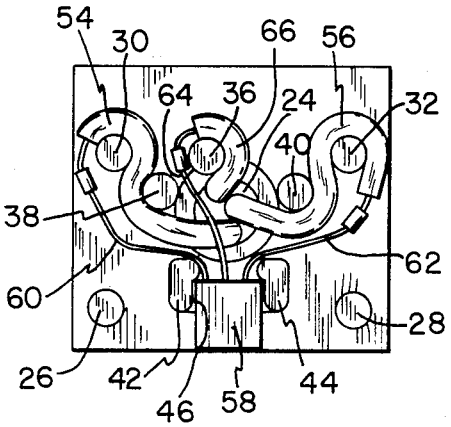
FIG. 7 is a top plan view of the supporting plate with a Hall effect sensor and electrical leads mounted in place thereon.
Figure 8:
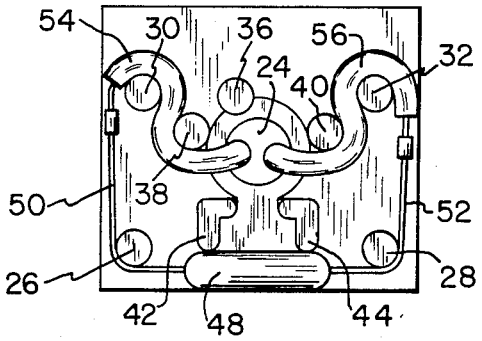
FIG. 8 is a similar view but with a reed switch and leads mounted thereon.

Adjacent to the aperture 24 are two L-shaped embossments 42 and 44 which define therebetween a part of a square recess 46. The plate as shown in FIGS. 6, 7 and 8 and the embossments are preferably integrally molded and are so formed as to receive either of two conventional magnetically operable switching devices. One of these may be a reed switch and the other a Hall effect sensor. Basically, the reed switch consists of two overlapping ferro magnetic blades termed as "reeds". The reeds are hermetically sealed inside an elongated glass tube 48 leaving a small air gap between them.

Since the reeds are magnetic, they will assume opposite polarity and be attracted to each other when influenced by a magnetic field. Sufficient magnetic flux density will cause the reeds to flex and contact each other. When the magnetic field is removed, they will again spring apart to their normal positions.

The reed switch is provided conventionally with two malleable, electrical leads 50 and 52 which are shaped or wrapped partially about the two embossments 26 and 28 as shown to extend substantially parallel to the opposite edges of the supporting plate 12. The two L-shaped embossments 42 and 44 are precisely spaced from the adjacent side 16 of the cover 14 such that the elongated switch 48 is gently but firmly held in place, the engagement of the leads 50 and 52 with the embossments 26 and 28, respectively, holding the reed switch against endwise movement, the ends of embossments 42, 44 and the adjacent side 16 of the cover 14 holding the switch against lateral movement, and the top of the cover 10 bearing gently against the switch 48 to hold it downwardly against the plate 12. Thus, the switch 48 is gently but firmly held in a predetermined location in the casing consisting of the cover 10 and plate 12.

The terminal leads 50 and 52 are electrically connected to terminal wires 25, these individually being indicated by the numerals 54 and 56. These wires 54 and 56 are formed about the embossments 30, 38 on the one hand and along side the embossments 32 and 40 on the other. From there, the wires bend over at right angles to bear against the rim of aperture 24 and extend through the aperture 24 which is otherwise indicated in FIG. 4 as being the terminal wires 25. In this case, of the reed switch, only two such terminal wires 25 will appear. Referring to FIG. 8, the wire lead 56 may also be wrapped partially around the two embossments 32 and 40 the same as the wire 54 is partially wrapped around the two embossments 30 and 38. The purpose of the embossments 30, 32, 38 and 40 is to positively locate the wires 54 and 56 and in conjunction with the rim of aperture 24 furthermore to restrain them against being pulled out of the casing when a when a pulling force is exerted on the leads 26 (FIG. 4.) or to strain the leads to the switch 48 or sensor 58. These embossments and the respective wires and leads are of sufficient stiffness that once bent around the various embossments as shown and described, they will also hold the magnetic switch 48 in place.

As an alternative, a Hall effect sensor may be used instead of the reed switch. This is more particularly shown in FIG. 7 wherein the Hall effect sensor is identified by the numeral 58, this sensor being rectangularly shaped and just fitting the shape of the recess defined by the two embossments 42 and 44 and the adjacent side of the cover 10. The top of the cover 10 just engages the upper side of the sensor 58 thereby to hold it downwardly in firm position against the plate 12. Thus, the sensor 58 is securely located in a predetermined position.

In mounting the sensor 58, the two embossments 26 and 28 are not used. Instead, the leads 60 and 62 therefrom are bent as shown and electrically connected to the wires 54 and 56 which are partially wrapped around the respective embossments as previously described. The sensor 58 is provided with a third lead 64 connected to a third terminal wire 66 which is passed about the embossment 36 as shown before exiting the aperture 24 to become one of the terminal wires 25.

Thus, it is shown that the same casing or package can be used to mount and secure either one of a reed switch or Hall effect sensor in a predetermined location.

Referring now to FIGS. 1 through 4, the switching device (sometimes denoted by numerals 10,12) shown in FIGS. 4 through 8 is adapted to be mounted on and secured in fixed relation to a flat supporting member such as a printed circuit board 68. This board 68 is provided with a square hole 70 of a size which intimately receives the square portion 20 on the projection 18. This then locates the projection 18 as well as the plate 12 and the cover 14 against rotation with respect to the board 68. In order to further secure the projection 18 to the board 68, a suitable fastening device may be used such as a substantially flat, spring type gripping or push-on nut 72 of conventional design which is merely slipped over the cylindrical extension 22 until the outer bent-over extremities engage the board 68. The nut 72 is so formed as to dig into the portion 22 thereby resisting withdrawal therefrom and otherwise securely fixing the projection 18 relative to the board 68. The magnetic device 10,12 of FIGS. 4 through 8 is thus securely positioned and mounted on the circuit board 68.

The magnetic switching device 10,12 is actuated by means of a permanently magnetized, disc-shaped rotor 74 mounted near the circuit board 68 in fixed relation thereto for rotation about its axis 76. Bearing washers 78 and 80 are provided on both sides of the circuit board 68 as shown, the washer 78 being engaged by a shoulder portion 82 on the rotor 74 and a suitable locking collar and set screw combination 84 engaging the washer 80 and being secured to the rotor shaft 86. A suitable electric motor or the like can be connected to the shaft 86 for imparting rotation to the rotor 74 at a constant or any selected speed.

The rotor 74 is fabricated of permanently magnetizable material, such as moldable plastic containing permanent magnet particles, such as barium ferrite. The face 88 of the rotor 74 immediately adjacent to the magnetic-switching device 10,12 is magnetized in a pattern of north and south poles circumferentially alternated as further indicated in FIG. 1. Shoulder 82 of the rotor 74 as well as the washer 78 are so sized as to locate the face 88 immediately adjacent to the magnetic switching device 10,12. Furthermore, the particular reed switch 48 of Hall effect sensor 58 is disposed to be directly beneath the outer peripheral portion of the face 88 and in registry with the poles as shown in FIGS. 1 through 3. The strength of the poles on the rotor 74 is selected to provide fields of sufficient intensity and distribution as to cut through the particular switching component 48,58 (reed switch of Hall effect sensor) to cause actuation thereof. Thus, as the rotor 74 rotates, the particular switching component 48,58 will be operated "on" and "off" alternately as the north and south poles pass thereby.

Since such switching components 48 and 58 are sensitive not only to the field strength but to the location of the field, it is important that in mass production quantities, the switching device 10,12 be so constructed that it will always be securely located in a predetermined position relative to the rotor 74. With this design parameter being assured, reliable operation of mass production quantities can be assured.

In a working embodiment of this invention, the Hall effect sensor 58 is part number UGN-3030U manufactured and sold by Sprague Electric Co., Concord, N.H.

The reed switch 48 is a model R.I. 22-3A manufactured by Amperex Electronics Corp., Hicksville, N.Y. All of the other parts are sized accordingly to secure the components 48 and 58 in predetermined position once the cover 14 is properly assembled to the supporting plate 12.

Figure 9:
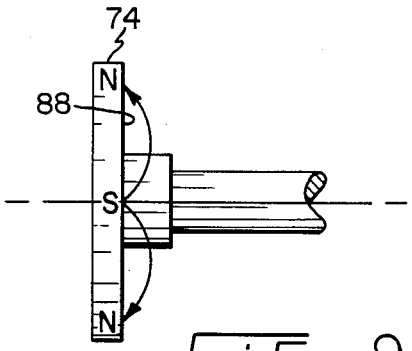
FIG. 9 is a side view of the disc-shaped magnet for the purpose of showing graphically the magnetic field produced thereby.

Referring further to FIG. 9, the field lines between poles on the face 88 of the rotor 74 are graphically illustrated.

While there have been described above the principles of this invention in connection with specific apparatus, it is to be clearly understood that this description is made only by way of example and not as a limitation to the scope of the invention.

What is claimed is:

1. Magnetic switch apparatus comprising:

a magnetically sensitive component, having electrical leads extending therefrom;

a casing which includes a supporting plate of non-magnetic material, having the magnetically sensitive component securely positioned therein;

first means for positioning the magnetically sensitive component in a predetermined location, including component-locating embossments on said supporting plate which receives and holds said component against movement in at least one direction;

second means for locating and holding said leads against movement thereof upon application of a tensile force thereto, including lead-locating embossments on said supporting plate about which said leads, respectively, are partially wrapped;

a lead-receiving aperture, formed in said plate, through which said leads extend after being wrapped as aforesaid about said lead-locating embossments; and third means for mounting said magnetic switch apparatus on a supporting member in a predetermined position such that said magnetically sensitive component will be correspondingly positioned relative to said supporting member.

2. The apparatus of claim 1 wherein said casing includes a cover of non-magnetic material having sides which snugly, securely fit over the perimetral edge of said plate, one of said holes being spaced from said component-locating embossments in juxtaposition therewith and engageably securing said component therebetween.

3. The apparatus of claim 1 wherein there are four of said lead-locating embossments spaced apart in substantially quadrature relation, two of said lead-locating embossments being in a first set on opposite sides, respectively, of said component-locating embossments and the other two being in a second set spaced from the first two in such arrangement that the four embossments are roughly located at the corners of an imaginary square with said component-locating embossments being positioned within said square, said component having two leads which partially wrap around the two embossments of one of said sets before exiting through said aperture.

4. The apparatus of claim 3 wherein said component is an elongated reed switch and said two leads thereof partially wrap first around said first set of embossments and then partially about said second set before exiting through said aperature.

5. The apparatus of claim 3 wherein said component is a Hall effect sensor with two leads thereof first partially wrapping about the second set of embossments before exiting from said aperture.

6. The apparatus of claim 4 wherein said supporting plate is orthogonally shaped with said four embossments being situated near the corners threof, and orthogonally shaped cover having four side walls which conform to and fit snugly over the peripheral edge of said plate, one of said side walls being spaced from said component locating embossments in juxtaposition therewith and engageably securing said reed switch therebetween.

7. The apparatus of claim 5 wherein said supporting plate is orthogonally shaped with said four embossments being situated near the corners thereof, an orthogonally shaped cover having four side walls which conform to and fit snugly over the perimetral edge of said plate, one of said side walls being spaced from said component locating embossments in juxtaposition therewith and engageably securing said Hall effect sensor therebetween.

8. The apparatus of claim 7 wherein said component-locating embossment in combination with said one side wall define an orthogonally shaped recess, said Hall effect sensor being orthogonally shaped and of a size substantially equal to said recess thereby to fit snugly thereinto.

9. The apparatus of claim 8 wherein said plate has at least one additional embossment disposed between the embossments of said second set, a third terminal lead extending from said Hall effect sensor and being wrapped partially around said additional embossment and passed outwardly of said aperture.

10. The apparatus of claim 1 wherein said third means includes a projection extending from said supporting plate on the side opposite said embossments, said projection adjacent to said plate in cross-section having an irregularity which precludes rotation when mounted in a correspondingly shaped opening in said supporting member.

11. The apparatus of claim 10 including a flat supporting member, said cross-section being square and fitting into a square opening in said supporting member, said projection beyond said cross-section being cylindrical and having said aperture therethrough, and a friction-gripping push-on nut fixedly securing said projection and said plate to said supporting member.

12. The apparatus of claim 11 including a disc-shaped permanent magnet member mounted on said supporting member for rotation about its axis and overlying in spaced relation said cover and said component, said magnet having the face adjacent to said cover magnetized with circumferentially alternating north and south poles which produce fields capable of actuating said component as said magnet member is rotated.

* * * * *